US005301918A

United States Patent [19]

Miller

[11] Patent Number: 5,301,918

[45] Date of Patent: Apr. 12, 1994

[54] FORM ASSEMBLY FOR CONSTRUCTION OF CONCRETE CULVERTS

[76] Inventor: C. B. Miller, 205 Lakin Dr., Huntsville, Ala. 35801

[21] Appl. No.: 817,382

[22] Filed: Jan. 6, 1992

[51] Int. Cl.[5] ..... E04G 9/00

[52] U.S. Cl. ..... 249/11; 249/93; 249/188; 249/209; 264/32; 264/34

[58] Field of Search ..... 249/1, 10, 11, 12, 19, 249/27, 93, 144, 188, 207, 209, 210; 264/32, 34, 35

[56] References Cited

U.S. PATENT DOCUMENTS

| | | | |
|---|---|---|---|
| 883,194 | 3/1908 | Guthrie | 249/11 |
| 1,722,038 | 7/1929 | Dougherty | 249/11 |
| 2,873,505 | 2/1959 | Sheldon | 249/10 |
| 3,696,177 | 10/1972 | Holland | 249/11 |
| 4,142,705 | 3/1979 | Miller | 249/188 |
| 4,219,513 | 8/1980 | Miller | 264/32 |

*Primary Examiner*—Jay H. Woo
*Assistant Examiner*—James P. Mackey
*Attorney, Agent, or Firm*—Phillips & Beumer

[57] ABSTRACT

A system for constructing concrete culverts is disclosed wherein reusable outer form and rebar supporting assemblies are set in place in an excavation and are used to form outer portions of the floor and outer walls of the culvert. Forming the outer walls of the culvert is facilitated by anchoring the lower regions of the form assemblies in the outer region of the floor as it is being poured by means of concrete anchors, which remain set in the concrete but are removable from the form assemblies. As a particular feature of this invention, the form assemblies are each provided with a protective wall spaced from the form assembly and adjacent walls of the excavation, forming a protective space where workers may work while being protected from collapse of walls of the excavation. As a further feature of this invention, a rebar supporting apparatus is disclosed as constructed of an L-shaped plate disposed for being fixed to timbers forming a riser for an inner wall of the culvert, with a vertical support provided with ledges or lips at a selected spacing to support the horizontal rebar for the interior wall, and which in turn are used to support vertical sections of the rebar positioned to be embedded in the riser. As yet another feature of this invention, an adjustable cable assembly is disclosed for anchoring top regions of the form assemblies together for pouring the outer walls, while the lower regions of the walls are anchored as described.

11 Claims, 5 Drawing Sheets

FORM ASSEMBLY FOR CONSTRUCTION OF CONCRETE CULVERTS

FIELD OF THE INVENTION

This invention relates generally to construction of concrete structures and particularly to a method and means of constructing a reinforced concrete rain water drainage culvert.

BACKGROUND OF THE INVENTION

The construction of concrete culverts and other generally hollow, reinforced rectangular structures requires that a complicated array of forms and reinforcing bars must be constructed and aligned prior to the actual pouring of concrete. These forms are constructed one section at a time, typically every 12 feet or so, and are customized for each discrete section of culvert. Of course, this is very expensive and time consuming; and as the work in most instances is performed underground or below ground level, a danger exists that a side of an excavation in which the culvert is being constructed may collapse, burying or otherwise trapping workmen constructing the forms.

Accordingly, applicant has devised systems disclosed in U.S. Pat. No. 4,219,513, issued on Aug. 26, 1980, and No. 4,142,705, issued on Mar. 6, 1979. The '705 patent shows a method for constructing a culvert wherein reinforcing bars, known in the art as "rebar," are hung from timbers supported by hangers, in turn hung on frame members which form the outer walls of the culvert. Rebar for an inner support wall of the culvert is hung from timbers, in turn supported by transverse timbers also supported by the hangers, with all the rebar extending into the floor of the culvert when concrete for the floor is poured. After the floor sets, all the hangers and timbers are removed, leaving the outer forms and rebar for the vertical walls of the culvert in place. Next, wheeled, mobile, interior forms for forming interior vertical walls and the interior ceiling wall of the culvert are positioned between the rebar in the now-cured floor and the outer forms and elevated a short distance by removable blocks. Tubes for weep holes are fixed in the upper portion of the mobile form, along with rebar for the ceiling of the culvert, and concrete is then poured for the vertical walls and ceiling.

The '513 patent is a division of the '705 patent and discloses substantially the same material as the '705 patent.

In accordance with the foregoing, it is an object of this invention to provide a method and apparatus for constructing a concrete culvert which affords greater safety than prior methods.

SUMMARY OF THE INVENTION

A form assembly is constructed having an outer frame and a form within the outer frame for forming liquid concrete on one side thereof. A plurality of openings in the form and through the frame below a level of a floor of the culvert are each provided with a removable concrete anchor so that when the floor is poured, the concrete anchors are submerged in concrete, and after the concrete hardens, the anchors are used to support lower regions of the forms. A protective wall is mounted to the back side of the form and protects workpersons from collapse of walls of an excavation in which the culvert is being constructed.

DETAILED DESCRIPTION OF THE DRAWINGS

Figure 1:
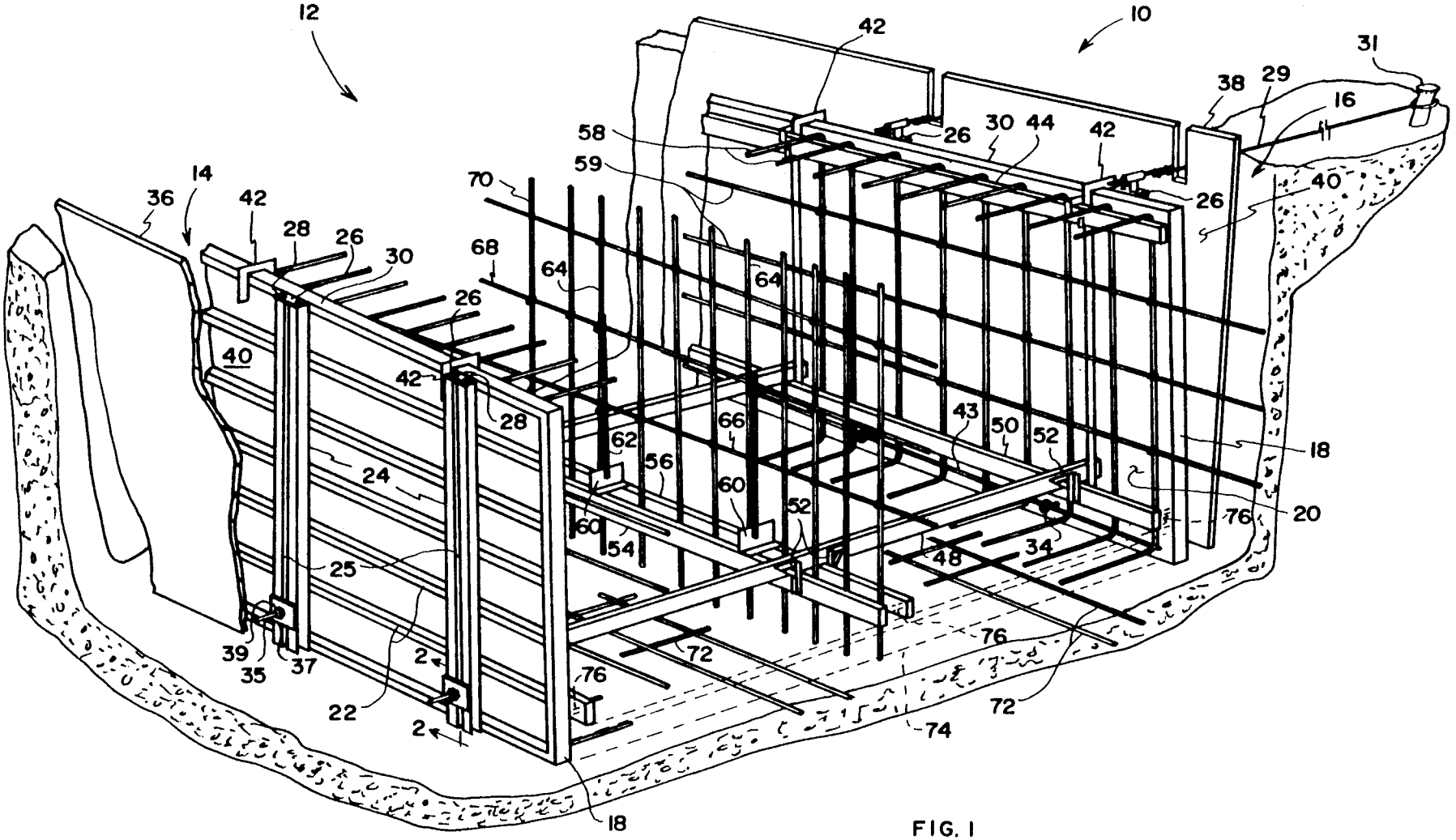
FIG. 1 is a perspective view of an excavation site with forms and supports of the present invention in place prior to pouring concrete for the floor of a culvert.

Referring initially to FIG. 1 a construction/excavation site 10 is shown wherein an underground culvert 12 is being constructed. As shown, the walls and floor of the excavation site are dug to the requisite dimensions in order to accommodate the culvert which, after being constructed, is typically buried underground. At the stage of construction shown in FIG. 1, the forms and reinforcing bars, hereinafter denoted as rebar, are shown in place just prior to pouring concrete to form a floor and risers for walls of the culvert.

As a particular feature of this invention, attention is directed to outer wall forms 14 and 16, which are reusable and specifically constructed for the purpose of constructing culverts. Forms 14 and 16, in this example, are each about 8 feet high and 12 feet long and are provided with a metal frame 18 surrounding an outside edge of forms 14 and 16, which lends necessary strength to the forms for moving and otherwise manipulating them. An inner wall region 20 is constructed of a strong material, such as fiberglass or steel, and is smooth so as to lend a smooth surface to the outer walls of the culvert. The reverse side of the forms are provided with ribs 22 spaced as needed for rigidity, for example, every 6 to 12 inches, ensuring that the forms do not bow outward due to hydraulic pressure from the concrete while it is in a liquid state. A series of cross braces 24, which may be vertical, as shown, or horizontal, are typically constructed of two pieces of channel iron positioned back to back, with a gap 25 therebetween, and spaced at intervals of about four feet. When vertically oriented, the braces are each provided with a top, flat plate member 26 having a pair of openings 28, with member 26 mounted generally flush with the top frame member 30. In the instance where braces 24 are horizontal, the openings 28 are provided in a top portion of frame 18 and spaced about every four inches. Cross braces 24 further reinforce ribs 22 and allow for convenience of moving the forms, as by a small crane or cables coupled to the bucket of a backhoe or the like, and the other ends of the cable are coupled, as by a hook, to engage openings 28 or in the openings of the top portions of the frame. Further, as will be explained, one of openings 28 is engaged by an adjustable cable assembly that prevents the forms from spreading outward as the side walls and top of the culvert are being poured. The other of openings 28 are engageable by a cable 29 or other support, in turn affixed to an anchor 31 positioned a safe distance from walls of the excavation. Cable 29 serves as a brace, preventing the form assembly from being toppled inward, possibly onto a workperson, in the event of collapse of walls of the excavation. Anchor 31 may be a stake driven into the ground, as shown, an existing tree, or any piece of heavy equipment suitable for providing support to the forms against inward movement. While anchors 31 and cables 29 are shown only on form assembly 16 in FIG. 1, it is to be appreciated that such anchors and cables would be placed as needed on all outer form assemblies in use. Openings 32 (FIG. 2) are provided along a lower region of forms 14 and 16 and extend therethrough and through gaps 25 of cross braces 24 below a level of the side of the concrete floor or riser for the side walls and are disposed to receive an anchor member 34, also as will be described. Lastly, as a safety feature, the forms are provided with clearance panels or walls 36 and 38 generally extending, for example, 18 inches above a top edge of forms 14 and 16 and which are mounted by a plurality of supports 17 (FIG. 5) coupled by conventional means (not shown) between vertical braces 24 and walls 36 and 38. Slots 41 are provided in an upper portion of these clearance panels for allowing cable 29 to pass therethrough. Mounted as such, walls 36 and 38 form a clearance region 40 sized about 18 inches at the bottom of the forms and about 24 inches at the top of the forms, permitting a workperson safe access between the clearance panels and the back sides of the forms. These clearance panels 38 serve to protect a workperson in the instance of collapse of walls of the excavation which, in the absence of such clearance panels, could do serious bodily harm thereto, or, if the collapse of walls of the excavation is extensive, suffocate such a person trapped between the collapsed wall of the excavation and the back of the form. It is to be noted that these clearance panels are mounted angularly with respect to forms 14 and 16, with a lower region of the panels being closer to the forms and the upper region being farther from the forms. As the outer forms 14 and 16 along with cables 29 and anchors 31 are left in place throughout the entire construction process of the culvert, which may take several days, partial collapses of the excavation are not uncommon, which would otherwise make the forms difficult to remove. The described tapered configuration between the outer clearance panels and the forms presents a wedge shape to dirt that has collapsed, making the forms easier to remove.

Figure 2:
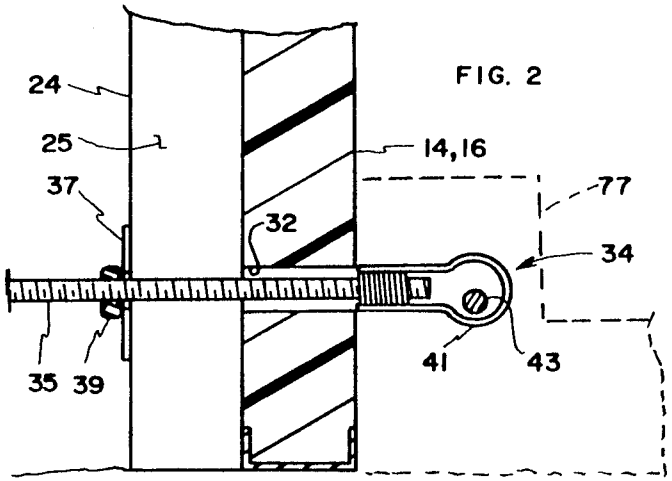
FIG. 2 is a sectional view taken along line 2—2 of FIG. 1 of an outer wall form of the present invention showing a concrete anchor and rebar therefor in dashed lines.

To construct the floor and risers 77 for the walls of the culvert, forms 14 and 16 are positioned as shown resting on a generally smooth prepared gravel layer at the bottom of the excavation. The forms are set the required distance apart and adjusted, as by a plumb bob or level, until they are "plumb," or perfectly vertical or nearly so, and then braced, as by stakes driven into the ground and braces extending from the stakes to the forms to maintain this orientation. Concrete anchors 34, as shown in FIG. 2, are mounted to inside regions of forms 14 and 16 by a short section of threaded rod 35 extending through openings 32 in forms 14 and 16. Rod 35 is screwed into anchor 34 from the outside of forms 14 and 16 through gap 25. A washer or plate 37 is placed over the threaded rod, and a nut 39 is threaded onto rod section 35 from the outside of forms 14 and 16, with nut 39 tightened after concrete has hardened around anchor 34. On the inside surface 20 of forms 14 and 16, the eyelet portions 41 of the anchors are aligned and a section of rebar 43 inserted through the eyelets as shown in FIG. 1. These concrete anchors are mounted flush with the inside region of the forms so that after concrete around them hardens, the threaded rod may be removed and the form lifted vertically with no interference from the concrete anchors set in the hardened concrete. Next, hangers 42, as shown and described in U.S. Pat. Nos. 4,142,705 and 4,219,513, and hereby incorporated herein by reference, are positioned and hung such as to support an upper section of dimension lumber, such as a 2-×-4 44, spaced from forms 14 and 16 and across the length of the top of forms members 14 and 16. In a typical application, at least two hangers are used for a set of forms 14 and 16 and are positioned thereon so they are opposed from one another. At the bottom of hangers 42, another section of dimension lumber 48 is affixed, as by nailing, such that section 48 is normal to forms 14 and 16. A lower section of lumber 50 is then supported from section 48 using triangular supports 52, also incorporated by reference from applicant's patents as described. Section 50 is positioned generally underneath section 44 but spaced outward from inner surface 20 of forms 14 and 16 such that a concrete riser 77 (FIG. 2), which varies in dimension, generally 6 to 12 inches, is formed when concrete is poured between the outer form and section 50.

Figure 3:
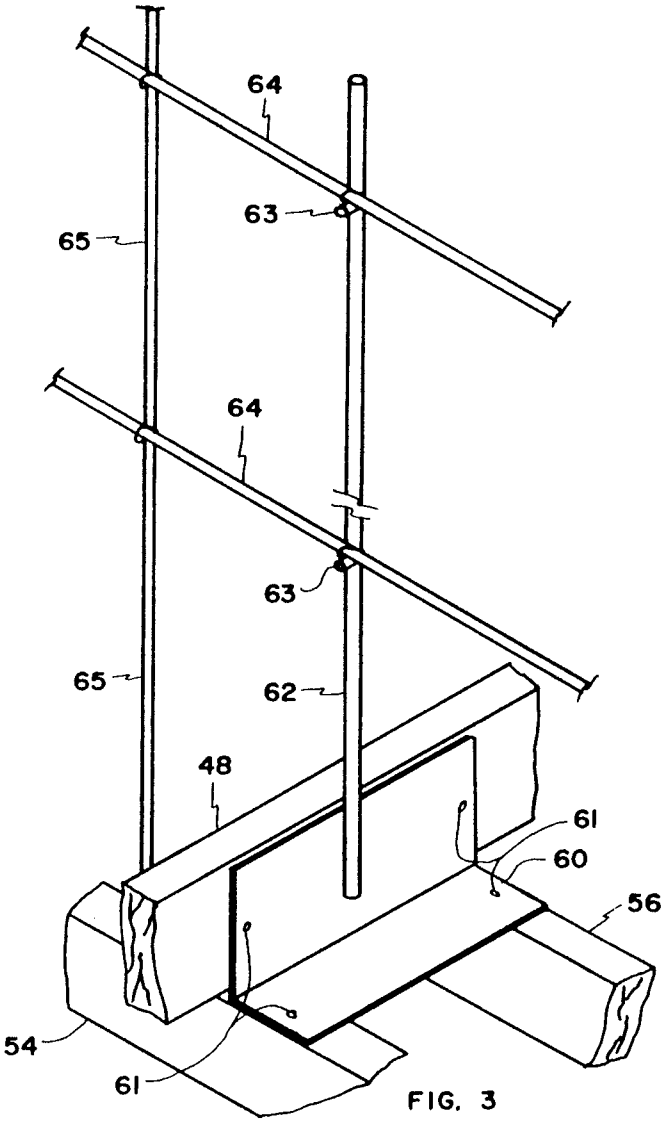
FIG. 3 is a perspective view of a vertical rebar support of the present invention.
Figure 4:
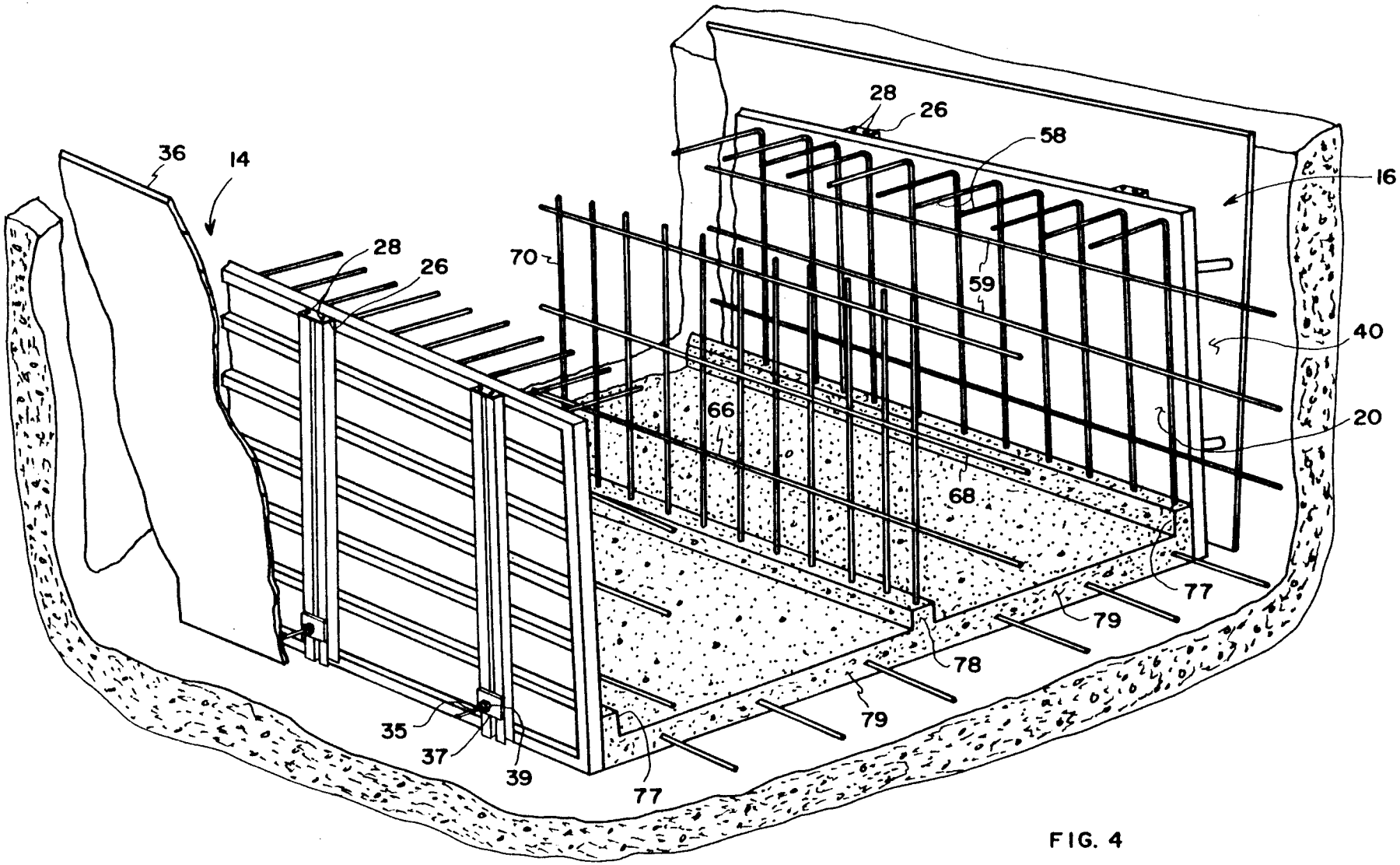
FIG. 4 is a perspective view of a floor of a culvert showing rebar embedded therein for walls of the culvert.

For forming a riser 78 for an interior support wall of the culvert, triangular supports 52 are used to support a pair of timbers 54 and 56 from timber 48, with lower edges of timbers 50, 54, and 56 horizontally aligned above the gravel layer to produce a floor for the culvert. Sections of rebar 58 are bent into a "U" shape and hung as shown from timbers 44 such that when the floor is poured, rebars 58 are embedded at their lower ends in the floor and are vertically oriented to be in the side walls of the culvert when it is poured. Horizontal sections of rebar 59 are tied to these vertical sections at a spacing as required by engineering parameters for strength, with at least some of this horizontal rebar extending past ends of forms 14 and 16 in order to link adjacent sections of culvert together. Straight sections of rebar are supported to extend from the center riser 78 by a support shown in FIG. 3. Here, a plate 60 is configured in an "L" shape and provided with small holes such that plates 60 ma be nailed to any of timbers 48, 54, and 56. A short section of rebar 62 is welded to plates 60 to extend vertically therefrom and is further provided with ledges or lips 63 so that a section of horizontally extending rebar 64 may be tied to section 62, with cross sections 64 tied to sections 62 and resting on lips or ledges 63. Ledges 63 serve to conveniently space the horizontal rebar at selected spacing, such as about 2 feet. Other sections of vertically extending rebar 65 are then tied to horizontally extending members 64, with all the vertically extending rebar 65 extending into the space below timbers 50, 54, and 56 where the center riser 78 for the center wall of the culvert is to be. Rebar 72 (FIG. 1) for the floor of the culvert is then positioned in a cross hatched pattern with at least some of the rebar extending past ends of forms 14 and 16 as described (only 4 shown for clarity of illustration) and spaced from the gravel layer by nondegradable debris, such as broken pieces of concrete blocks or bricks. Lastly, end timbers 74 (dashed lines) are supported from timbers 50 by triangular members 52 in order to close the floor form, with the extending rebar for the floor extending through timbers 74, preventing the liquid concrete from flowing past ends of the forms 14 and 16. Smaller sections of timber 76 (dashed lines) are positioned to close ends of the riser timbers 50, 54, and 56, and concrete is then poured into the floor space to form the floor, into the space between timbers 54 and 56, and between timbers 50 and interior walls 20 of forms 14 and 16. After the concrete cures sufficiently, the hangers and timbers are removed and nuts 39 are tightened, leaving the forms 14 and 16 attached at their lower sides to the outer wall risers 77 and the vertically extending rebar in the outer wall risers 77 and in the center wall riser 78 embedded in concrete, as shown in FIG. 4.

Figure 5:
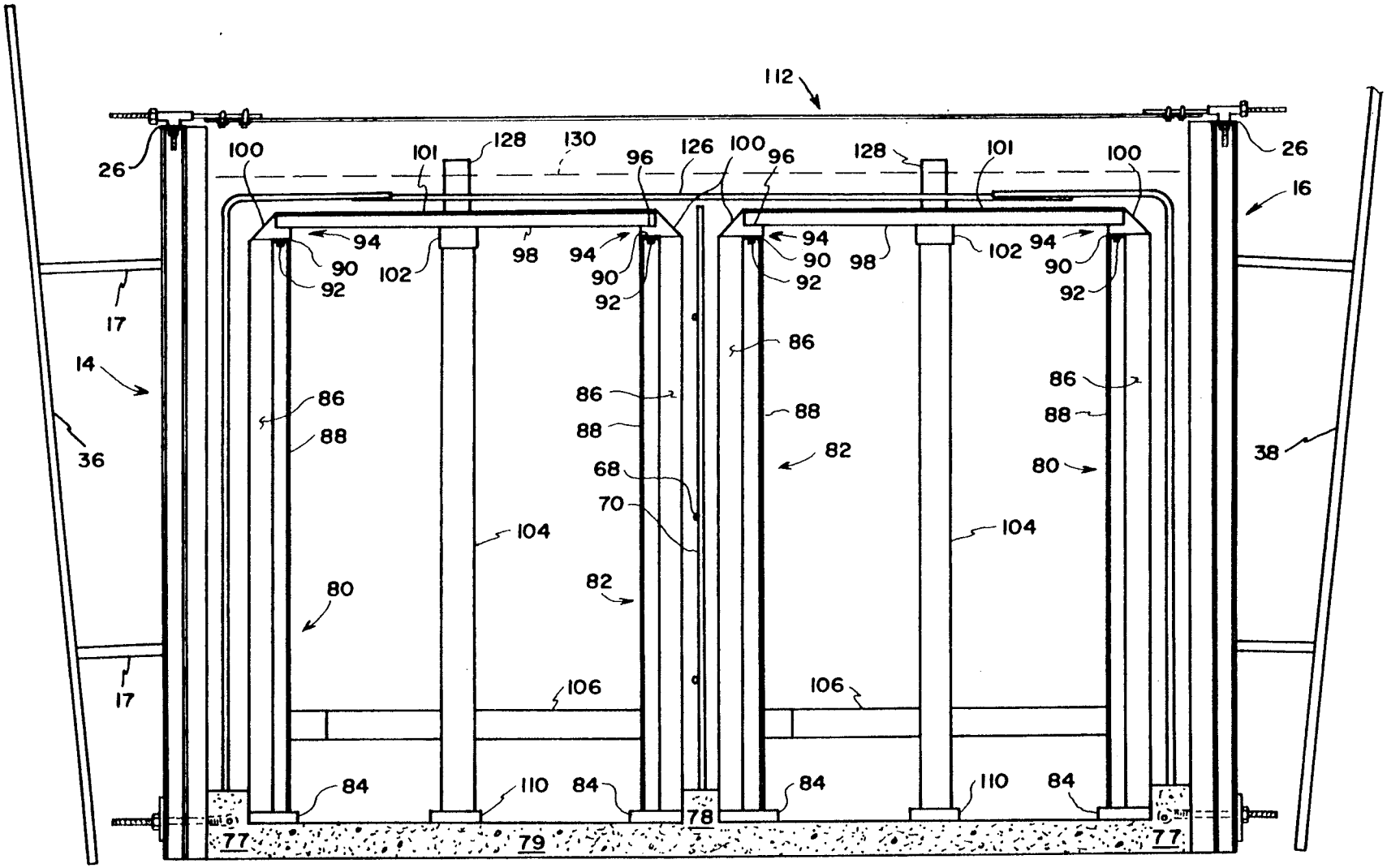
FIG. 5 is an end view of interior and exterior forms in place about the floor of a culvert and prior to pouring concrete for walls and a ceiling therefor.
Figure 6:
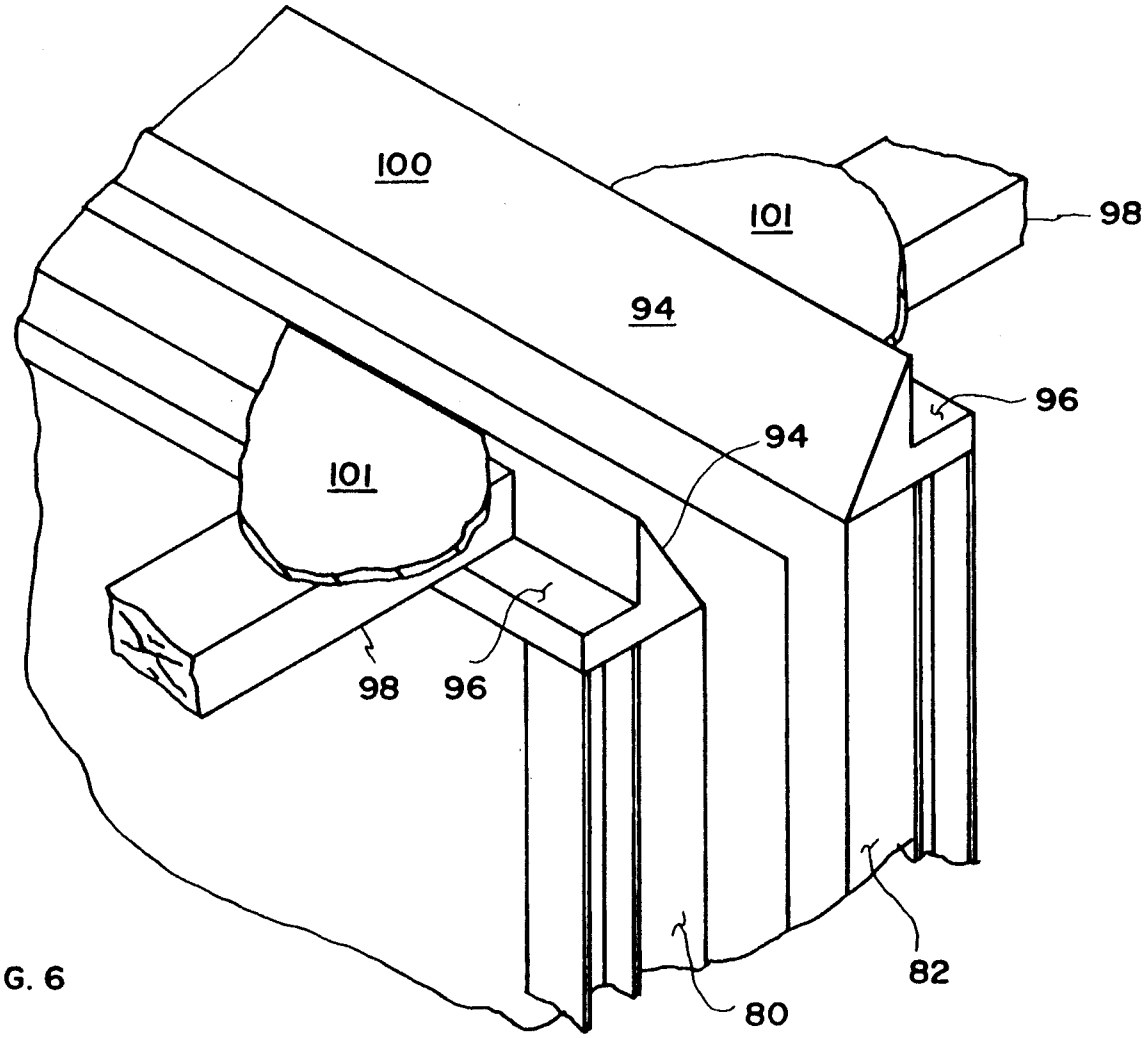
FIG. 6 is a perspective view of a top region of forms of the present invention.

In order to construct the side and top walls of the culvert, and referring now to FIG. 5, inner side forms 80 are positioned against inner sides of risers 77 and like inner side forms 82 against both sides of center riser 78. Forms 80 and 82 are constructed similarly to forms 14 and 16 and are provided with a metal outer frame 86 and a plurality of vertical or horizontal channel iron braces 88. A coupling plate 90 is affixed, as by welding, to the tops of vertical braces 88 and is provided with an opening through which a fastener 92 is passed and which couples an upper form member 94 to the top edge of frame members 80 and 82. As more clearly shown in FIG. 6, upper form members 94 are constructed having an inner notch 96 within which a cross brace 98 is fitted, this brace serving to prevent the top of forms 80 and 82 from being forced apart when concrete is poured between forms 14 and 80, 16 and 80, and between forms 82. Upper form members 94 are each further provided with a beveled surface 100 that forms a beveled transition region between inner walls of the culvert and inner ceilings thereof. The ceiling of the culvert is formed by flat sheets 101, typically of plywood, placed over cross braces 98, which are spaced as required in order to support the weight of the liquid concrete until it cures. Cross braces 98 are further supported by braces 102, which are positioned underneath and generally lengthwise to the culvert, and in turn are supported by vertical supports 104. Lower cross braces 106 are positioned as shown between angle iron braces 88 of inner forms 80 and 82 to prevent lower portions of forms 80 and 82 from being forced inward by liquid concrete as described above, and are blocked in place. Blocks 84 are placed under the forms 80 and 82 to allow removal of the forms, and blocks 110 are placed under vertical supports 104 to allow their removal.

Figure 7:
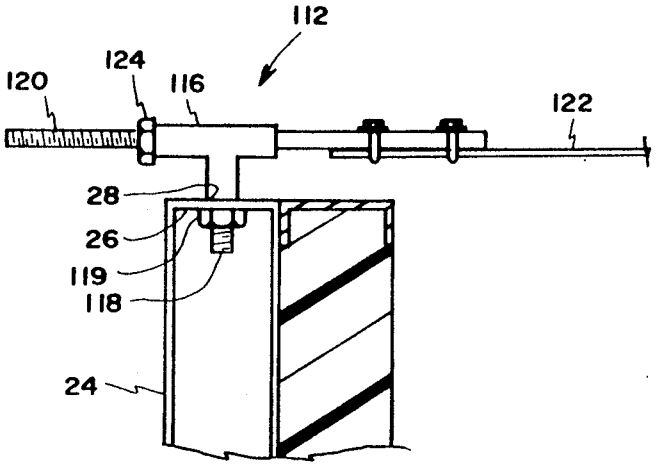
FIG. 7 is a planar view of an outer form cable support of the present invention.

Upper portions of the outer forms 14 and 16 are prevented from being forced outward by an adjustable-in-length cable assembly 112, which engages openings 28 in plates 26 or in the openings in the top portion of the frame and extends over the top of the culvert. As shown in FIG. 7, cable assemblies 112 are constructed at each end of a hollow, T-shaped body 116 having a threaded stud 118 which engages openings 28 of plates 26, with nut 119 engaging stud 118. A short section 120 of threaded rod is clamped or otherwise fixed to both ends of a cable 122, with the threaded rod extending through body 116 and provided with an adjustment nut 124 on an opposite side thereof. In this manner, rigidity is provided against upper portions of the forms from being forced apart by the liquid concrete. Additionally, a like mounting arrangement may be provided for cables 29 for bracing the forms against inward movement as described. Alternately, instead of using separate cables 29 coupled to anchors 31, cable assemblies 112 may be reversed and coupled to anchors 31. In this instance, cable assemblies 112 would be installed early as described in the construction process for protection of workpersons, and reversed to brace the form assemblies from outward movement just prior to pouring concrete for the walls of the culvert, at which time interior horizontal bracing for the form assemblies 14 and 16 would prevent them from being toppled inward by collapse of the walls of the excavation.

After the inner sides and plywood top are in place and braced as described, rebar 126 is placed in a cross hatched pattern on the top of the plywood and spaced therefrom by debris as described. Tubular form members 128 are mounted by means not shown along a center line of the culvert ceilings to form weep openings typically every 6 feet. Concrete is then poured into the spaces between forms 14 and 80, 16 and 80, and between forms 82 to form walls of the culvert. After these spaces are filled, concrete is poured over the ceiling plywood to a depth as required depending upon the depth the culvert is to be buried, as represented by dashed line 130. The concrete is then allowed to cure, whereupon the interior wall forms 88 are removed by first removing blocks 84 and then lowering the forms so they may be withdrawn from the culvert. Vertical braces 104 are likewise removed, which in turn allow cross braces 98 and plywood 98 to be removed. The outer forms 14 and 16 are removed by first removing cable assembly 112 and cable 29 and loosening nuts 39, unscrewing rods 35, and removing them. The cables 29 are removed, allowing forms 14 and 16 to be lifted vertically and moved as described in front of the newly-formed Section of culvert in preparation of forming the next section of culvert.

Having thus described my invention and the manner of its use, it is apparent that a variety of incidental modifications may be made thereto that fairly fall within the scope of the following appended claims, wherein I claim:

1. A form system for construction in an excavation of a concrete culvert having an inner cavity comprising:

a for assembly comprising:

first and second spaced, vertical, opposite frame members on opposite sides of said cavity, each having an inner and outer side, first and second form members supported by said inner sides of said first and second frame members, respectively, and the combination of one said form member and its supporting frame member being a frame assembly, a plurality of spaced openings in a lower region of each of said form members, a concrete anchor positioned in each of said openings removably supporting each said form member and extending inward in said cavity such that when a lower region of liquid concrete is poured, aid anchors are submerged in liquid concrete and anchored therein after said concrete is hardened, initially securing a lower region of said first and second form members to sides of said lower region of concrete;

a protective wall spaced outward from each said frame assembly and forming a human passageway between said frame assembly and said protective wall; and a plurality of supporting members, each being attached between a said frame assembly and a said protective wall, and positioning each said protective wall in a taper increasing in spacing with respect to a said frame assembly as a function height and being supported from said lower region of concrete, through said concrete anchors, and enabling maximum personal protection for workers.

2. A system as set forth in claim 1 comprising:

a plurality of hangers disposed for being hung from an outer side of an upper, horizontal frame portion of each of said first and second frame members;

a first support member supported by said hangers, for supporting rebar for an outer wall of said culvert in selected, spaced relation from an inner side of an associated form member while said lower region of liquid concrete is being poured, submerging a lower end of said rebar for said outer wall in said lower region of liquid concrete; and a plurality of transverse support members, which in turn support, and said form system includes, rebar supporting members disposed in longitudinal relation with said culvert, for supporting rebar for an inner wall of said culvert while concrete is being poured.

3. A system as set forth in claim 2 wherein said rebar supporting members each comprises:

a pair of central support members longitudinal with respect to said culvert and supported underneath said transverse support members;

a generally flat plate provided with a lip on one side thereof, said lip secured to said central support members; and a vertically extending pole having spaced lips thereon for supporting rebar in selected, vertically spaced relation, said pole fixed to an opposite side of said plate such that a lower end of said rebar for said inner wall is submerged in said liquid concrete.

4. A system as set forth in claim 3 wherein said pair of said central support members are secured to said transverse members in generally parallel, spaced relation by a plurality of brackets, each bracket fixed to a said transverse support member and having a downwardly depending leg attached to one of said central support members.

5. A system as set forth in claim 4 comprising additional form members secured to an underneath said transverse members adjacent to inner sides of said first and second form members by brackets and in aligned horizontal relation with said pair of central support members, wherein when concrete is poured between said outer form members and said additional form members and between said pair of central support members, outer sides of said lower region having said rebar embedded therein are formed into risers for said outer walls, and a central longitudinal region for said inner wall having said rebar embedded therein is formed into a riser for said inner wall.

6. A system as set forth in claim 5 wherein after said concrete for said lower region of concrete hardens, said hangers, said first support members, said transverse support members, said central support members, said additional form members, and said rebar supporting members are removed, leaving said form members anchored to said sides of said lower region of concrete, with said rebar embedded in said risers for said outer walls and said riser for said inner wall;

an inner form positioned proximate an inner side of each said riser for said outer walls, for forming said outer walls of said culvert; and a pair of inner form members positioned proximate opposed sides of said riser for said inner wall, for forming said inner wall.

7. A system as set forth in claim 6 comprising adjustable-in-length brace assemblies coupled at first and second ends to an upper portion of said first and second frame members, respectively, for preventing said first and second form members from being urged outward as concrete for said outer walls of said culvert is being poured.

8. A system as set forth in claim 6 comprising at least one cable for each said first and second form members and coupled at one end to an upper side of each of said frame members, said cable coupled at an opposite end to an anchor member spaced from said walls of said excavation for preventing said form members from being forced inward by collapse of said walls of said excavation.

9. A system as set forth in claim 6 wherein said inner form for forming inner regions of said outer walls and said pair of inner form members for said inner wall are each provided at their upper, narrow sides with beveled regions, for forming a beveled transition region between a ceiling of said culvert and said inner and outer walls of said culvert.

10. A form system for construction of concrete culverts having at least two drainage openings, comprising:

first and second outer form and rebar supporting assemblies, each comprising:

an outer, vertically positioned frame;

a form within said frame having an inner surface disposed for forming liquid concrete and an outer surface having horizontal integral ribs thereon;

a plurality of vertical braces on said outer surface of said form, with a plurality of openings in said form adjacent to said braces and below a level of a floor of said culvert;

a concrete anchor positioned in each said opening and removably secured to said first and second form assemblies via said braces such that said concrete anchors are submerged in liquid concrete as said floor of said culvert is poured, anchoring said first and second form assemblies to said floor after said concrete has hardened;

a protective wall mounted in tapered relation to each said form within said frame adjacent to a wall of an excavation, with the dimension of spacing between said protective wall and a said form within said frame increasing as a function of height;

a plurality of hangers hung along inner sides of each of said first and second form assemblies, for supporting a rebar support member for holding wall rebar of said culvert in position to be embedded in said floor;

a plurality of transverse members supported by said hangers, for supporting longitudinal form members thereunder, for forming a riser for an inner wall of said culvert;

rebar support members attached to said longitudinal form members, for vertically supporting rebar to be embedded in said floor; and an adjustable cable assembly coupled to each end to upper portions of each said frame, for securing same and preventing each of said first and second form assemblies from being forced outward as concrete for outer walls of said culvert is being poured.

11. A system as set forth in claim 1 wherein said concrete anchors in each of said sides of said lower region of said culvert are removably coupled to respective ones of said first and second frame members so that said frame assembly is removable from said sides of said lower region of said culvert.

* * * * *